US006640599B1

(12) United States Patent
Persson

(10) Patent No.: US 6,640,599 B1
(45) Date of Patent: Nov. 4, 2003

(54) TOOL FOR AUTOMATIC ROLL FOLDING

(75) Inventor: Jan Persson, Olofstrom (SE)

(73) Assignee: ABB AB (SE)

( * ) Notice: Subject to any disclaimer, the term of this patent is extended or adjusted under 35 U.S.C. 154(b) by 0 days.

(21) Appl. No.: 09/936,581

(22) PCT Filed: Mar. 20, 2000

(86) PCT No.: PCT/SE00/00548

§ 371 (c)(1),
(2), (4) Date: Sep. 13, 2001

(87) PCT Pub. No.: WO00/54902

PCT Pub. Date: Sep. 21, 2000

(30) Foreign Application Priority Data

Mar. 18, 1999 (SE) ..... 9900982

(51) Int. Cl.[7] ..... B21D 39/02

(52) U.S. Cl. ..... 72/210; 72/214; 72/312; 29/243.58

(58) Field of Search ..... 72/210, 211, 214, 72/312–315; 29/243.58, 243.57, 243.5

(56) References Cited

U.S. PATENT DOCUMENTS

| | | | | |
|---|---|---|---|---|
| 1,046,020 A | * | 12/1912 | Rhodes | 72/210 |
| 1,650,584 A | * | 11/1927 | Nelson | 72/214 |
| 2,091,474 A | * | 8/1937 | Elliott | 72/214 |
| 4,284,022 A | * | 8/1981 | Kanazawa | 72/210 |
| 5,228,190 A | * | 7/1993 | Sawa | 29/243.58 |

FOREIGN PATENT DOCUMENTS

| | | | |
|---|---|---|---|
| DE | 25 58 269 | | 12/1976 |
| EP | 0 525 759 | | 2/1993 |
| EP | 0 577 876 | | 1/1994 |
| JP | 7-290 158 | * | 4/1991 |
| JP | 8-164433 | * | 6/1996 |

OTHER PUBLICATIONS

Patent Abstracts of Japan, vol. 11, No. 123, (M–581), abstract of JP 61–262432 A (Torai Eng K.K.), Nov. 20, 1986.
Patent Abstracts of Japan, vol. 14, No. 486, (M–1038), abstract of JP 2–197331 A (Kanto Auto Works Ltd.), Aug. 3, 1990.

* cited by examiner

*Primary Examiner*—Daniel C. Crane
(74) *Attorney, Agent, or Firm*—Bachman & LaPointe, P.C.

(57) ABSTRACT

A folding tool for automatic roll folding comprises a first member (2) which is fixed to a manipulator, and a second member (3), which is rotatably connected to the first member (2). The second member (3) includes a first folding roller (4). A spring is disposed to permit a relative movement between the first member (2) and the second member (3), under the action of a force, which is increased by the movement. A method of roller folding by means of a folding tool, which includes a first member (2) fixed to a manipulator, and a second member (3) which is pivotal relative to the first. The second member is provided with a folding roller and is actuated by a spring force, which is directed away from the first member.

14 Claims, 9 Drawing Sheets

TOOL FOR AUTOMATIC ROLL FOLDING

TECHNICAL FIELD

The present invention relates to a folding tool for automatic roll folding, and comprises a first member fixed to a manipulator, a second member movably connected to the first member and including a first folding roller, and a spring disposed to permit a relative movement between the first member and the second member, under the action of a force increased by the movement.

The present invention also relates to a method of roll folding by means of a folding tool which comprises a fixed first member at a manipulator and a second member movably connected to the first part and having a folding roller, the member being urged away from the first member by a spring force directed away from the first member.

Finally, the present invention also relates to the use of the above-outlined folding tool and the reduction into practice of the above-outlined method.

BACKGROUND ART

In the joining together of two sheet metal parts in such contexts where the requirements on surface finish are high, folding is often employed as a better alternative to welding. The folding process is such that one of the workpieces is given an edge portion projecting out over the second workpiece, the edge portion being folded in over the second workpiece and urged against it such that the edge of the second workpiece will be accommodated between the first workpiece and its folded-over edge portion. For the above-mentioned folding over of the edge portion of the first workpiece, use is generally made of a roller which is displaced in the longitudinal direction of the edge portion.

EP 577 876 discloses a folding apparatus mounted on an industrial robot. The apparatus described in this publication has a first guide member which is immovably secured in the movement devices of the robot, and a second guide member which is accommodated in and displaceably guided in a recess in the first guide member. The two guide members thereby together form a telescope arrangement. Between the two mutually movable guide members, a spring is disposed which affects the movements between the guide members and is directed to counteract movement of the guide members towards one another. The above-described construction makes for the movement of the folding roller from and towards the movement devices of the robot which is necessary for an adequate folding result. However, the precision in the movements of the folding roller is far too poor because of the selected formation of the guide.

In the above-outlined construction, the folding roller is also located a considerable distance laterally outside the longitudinal direction of the telescope arrangement, which coincides with the direction of movement of the second guide member. Hereby, the guide member will be obliquely loaded so that a "jammed drawer effect" may be feared. Such an oblique loading destroys the precision in the movements, since the smallest play in the telescopic guide because of the large lateral projection of the folding roller gives large movements in the folding roller. In addition, a considerably harder wear on the mutually movable components may be feared than would otherwise be the case.

The prior art apparatus has only a single folding roller, for which reason time-consuming readjustment work or retooling will be the result.

ACCOUNT OF THE PRESENT INVENTION

The present invention has for its object to design the folding tool intimated by way of introduction such that it obviates the drawbacks inherent in prior art technology. In particular, the present invention has for its object to design the folding tool in such a manner that the folding roller will have a guiding with considerably higher precision than that which can be achieved employed prior art technology. Further, the present invention has for its object to realise a folding tool which is not subjected to oblique loadings which may destroy the service life or affect the movement pattern of the folding roller. Finally, the present invention also has for its object to realise a folding tool which is extremely robust and operationally reliable when in use.

The objects forming the basis of the present invention will be attained if the folding tool intimated by way of introduction is characterized in that the second member is rotatably connected to the first member.

In that the second member with the folding roller in principle executes a pendulum motion, its guiding can be made with considerably greater precision than is the case in a telescope arrangement with a folding roller projecting considerably in the lateral direction. Further, tendencies for oblique loading will be eliminated or reduced as a result of this construction.

Another object of the present invention is further to improve the precision of the folding tool.

According to the present invention, this is attained in that the folding tool includes a support roller and a plane roller, the support roller having a diameter which is greater than that of the plane roller, and the rollers being disposed to freely rotate about the same axis.

As a result of these features, the advantage will be afforded that the precision of the folding will not only be dependent on the accuracy of the movement pattern of the manipulator and the precision of the folding tool, but may be further improved by the abutment of the support roller against the workpiece or that surface on which it rests.

A further improvement of the precision of the folding, in particular in the lateral direction (sideways) will be achieved if a guide roller is employed during the final compression of the union, the so-called final folding. This guide roller is disposed to abut against a guide path which may be an integral part of the bed on which the workpiece rests. The axes of the guide roller and the folding roller intersect one another substantially at a right angle. As a result, the abutment pressure of each respective roller can be adjusted independently. It is thus possible to affect the abutment pressure of the folding roller against the workpiece without actuation.

Furthermore, the present invention has for its object to improve the flexibility and production capacity of the apparatus according to the present invention.

This object is attained if the folding tool includes a second folding roller which is rotary about an axis separate from the axis of the first roller.

As a result of these features, the advantage will be afforded that the folding tool need only be given new orientation in relation to the workpiece before a new working phase is commenced.

Finally, the present invention has for its object to realise the possibility of varying the spring constant in the spring which is included in the folding tool.

This object is attained in that the spring comprises a gas spring which has an expandable bellows containing a gas.

As a result, the possibility will be afforded of rapidly varying the force with which the folding tool abuts against the workpiece.

BRIEF DESCRIPTION OF THE ACCOMPANYING DRAWINGS

The present invention will now be described in greater detail hereinbelow, with reference to the accompanying Drawings. In the accompanying Drawings.

DESCRIPTION OF PREFERRED EMBODIMENT

The present invention will be described hereinbelow by way of example as applied in an industrial robot. Naturally however, it can be applied in any other type of movement apparatus or manipulator which can create the requisite relative movement pattern between a workpiece and a folding tool, which in practice includes a folding roller which abuts against and rolls along the workpiece. The term 'manipulator' should thus be interpreted so broadly that it also encompasses an apparatus which displaces a workpiece in relation to a fixedly disposed folding tool, as well as apparatuses in which both the workpiece and the folding tool move.

On folding, the workpieces rest on a support bed 28 (intimated only in FIG. 9), which partly serves the function of defining the form of the finished fold, and partly functions as an abutment surface for the workpieces when these, during the final phase of the folding operation, are processes by a folding roller.

Figure 1:
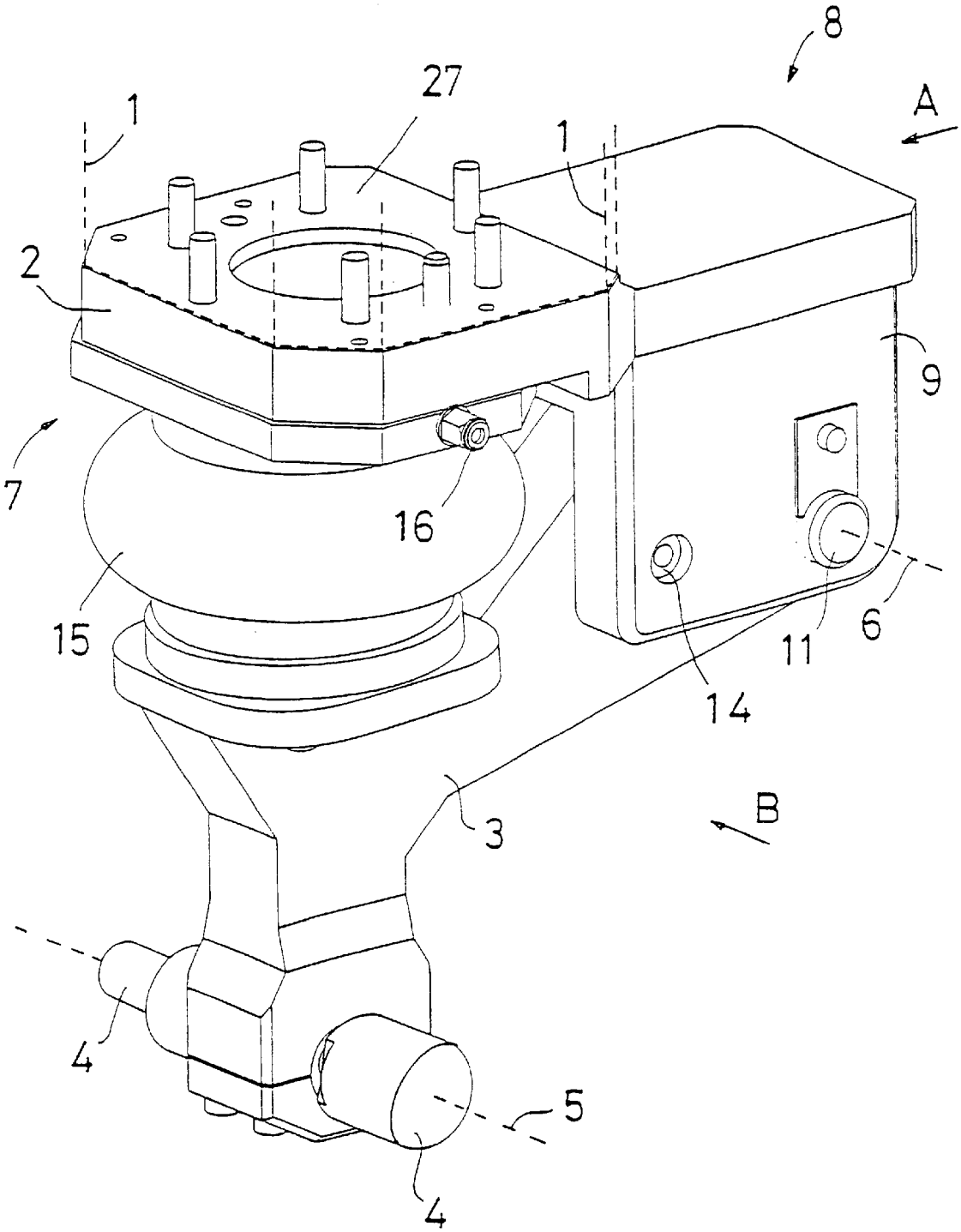
FIG. 1 is a perspective view of the apparatus according to the present invention.

In FIG. 1, broken lines intimate a movement apparatus or a manipulator included in an industrial robot, the manipulator being that section of the industrial robot which is movable along extremely complicated movement patterns and which serves for securing such end effectors or equipment as the robot is to handle. Reference numerals 2 and 3 relate to first and second support members, respectively, support members in which the first or upper support member 2 is secured in the manipulator 1 of the robot by means of suitable bolt unions and associated guide surfaces. The second or lower support member 3 supports on either side a folding roller 4 which is rotatably journalled in relation to the second support member which is rotatable about a common first shaft or axis 5. The folding rollers 4 are intended to be in contact with and urge against an edge portion of the workpiece which is to be folded, i.e. move along a folding path. Interchange between the two folding rollers may take place by rotating the apparatus according to the present invention about a vertical axis 24 (FIG. 3), e.g. by movement in the robot.

The second support member 3 is movable in relation to the first support member 2 and is in particular pivotal in relation to it about a second axis 6 which is located a distance from the first axis 5 and the anchorage of the support member 2 in the manipulator and which, in the illustrated embodiment, is parallel with the first axis 5. This implies that the second support member 3 can execute a pendulum pivotal motion about the second axis 6, whereby the distance between the first axis 5 and the folding roller 4, on the one hand, and the manipulator 1 of the robot on the other hand is changeable as a result of this pivotal movement.

When the apparatus according to the present invention is in operation, it is displaced along a folding path, i.e. along an edge portion of a workpiece which is resting or fixedly clamped on a support bed 28 (FIG. 9) under the action of the manipulator 1 in a direction which is substantially at right angles to the axis 5. Other angles may also occur. As a result of the pivotal mobility of the folding roller 4 towards and away from the manipulator 1, the folding roller will also be movable in a direction which intersects the plane defined by the first axis 5 and the movement of the folding roller 4 along the folding path. As a result, the folding roller 4 is movable towards and away from the folding path, i.e. the workpiece, under the action of the pivotal movements of the second support member 3 in relation to the first support member 2.

The axes 5 and 6 are, in the currently described embodiment as intimated above, substantially parallel with one another but are located in spaced apart relationship. In order to achieve this, the lower or second support member 3 is approximately in the form of an L, where the folding roller 4 is disposed in the region of the free end of the shorter shank, while the second axis 6 is disposed in the region of the free end of the longer shank.

The first support member 2, i.e. the support member secured in the manipulator 1, is elongate, flat-shaped and has a first end portion 7 with an upwardly facing surface 27 in abutment against the manipulator 1, the support member 2 being positionally fixed in the manipulator 1 by means of the above-mentioned bolt union and suitable guide surfaces. The opposite, second end portion 8 of the first support member 2 is located in the region of the second shaft 6. The second end portion 8 of the support member has, on its side facing away from the manipulator 1, two mutually parallel lugs 9 and 10 between which the longer shank of the second support member 3 is accommodated and guided so that all movements than the above-mentioned pivotal or pendulum movement are prevented. The pivotal or rotary connection between the two support members is achieved by means of a journal pin 11 which extends through both of the lugs 9 and 10, and also an aperture provided with a bushing in the second or lower support member 3. Between the inside of the two lugs 9 and 10 and the side surfaces of the second support member 3, there are disposed journal washers 12 and 13 so that the second or lower support member 3 will be accurately guided in relation to the first support member 2 both in the axial direction of the journal pin 11 and radially in relation to this journal pin.

In order to restrict the pivotal capability of the lower support member 3, this has an elongate and arcuate curved aperture (not shown on the Drawings) around the second axis 6 through which a locking pin 14 extends. The locking pin 14 is secured in both of the lugs 9 and 10.

As was mentioned above, the folding roller 4 is movable towards and away from the manipulator 1 of the robot in a direction which bisects that plane which is defined by the first axis 5 and the movement direction of the folding roller 4 along the folding path. This movement of the folding roller 4 towards and away from the manipulator 1 and towards and away from the folding path, i.e. the workpiece, is influenced by spring means which includes an inner bellows 15 actuable by a gaseous pressure medium. The bellows 15 has an inlet 16 for the above mentioned pressure medium which is in flow communication with an apparatus for rapid supply of or evacuation of the gaseous pressure medium. Hereby, the spring constant of the spring 15 may rapidly be modified. On pressurising the interior of the bellows 15, there will be realised a spring force which strives to displace the folding roller 4 in a direction away from the manipulator, i.e. towards the workpiece. If the manipulator 1 is seen as fixedly clamped in relation to the folding path, a change to the inner pressure in the bellows 15 will also imply a change of the force with which the folding roller 4 abuts against the workpiece. As is apparent from the Drawings, the bellows 15 is placed between the two support members 2 and 3 and, in particular, in the region of the end portion 7 of the first support member 2 co-operating with the manipulator 1.

Figure 2:
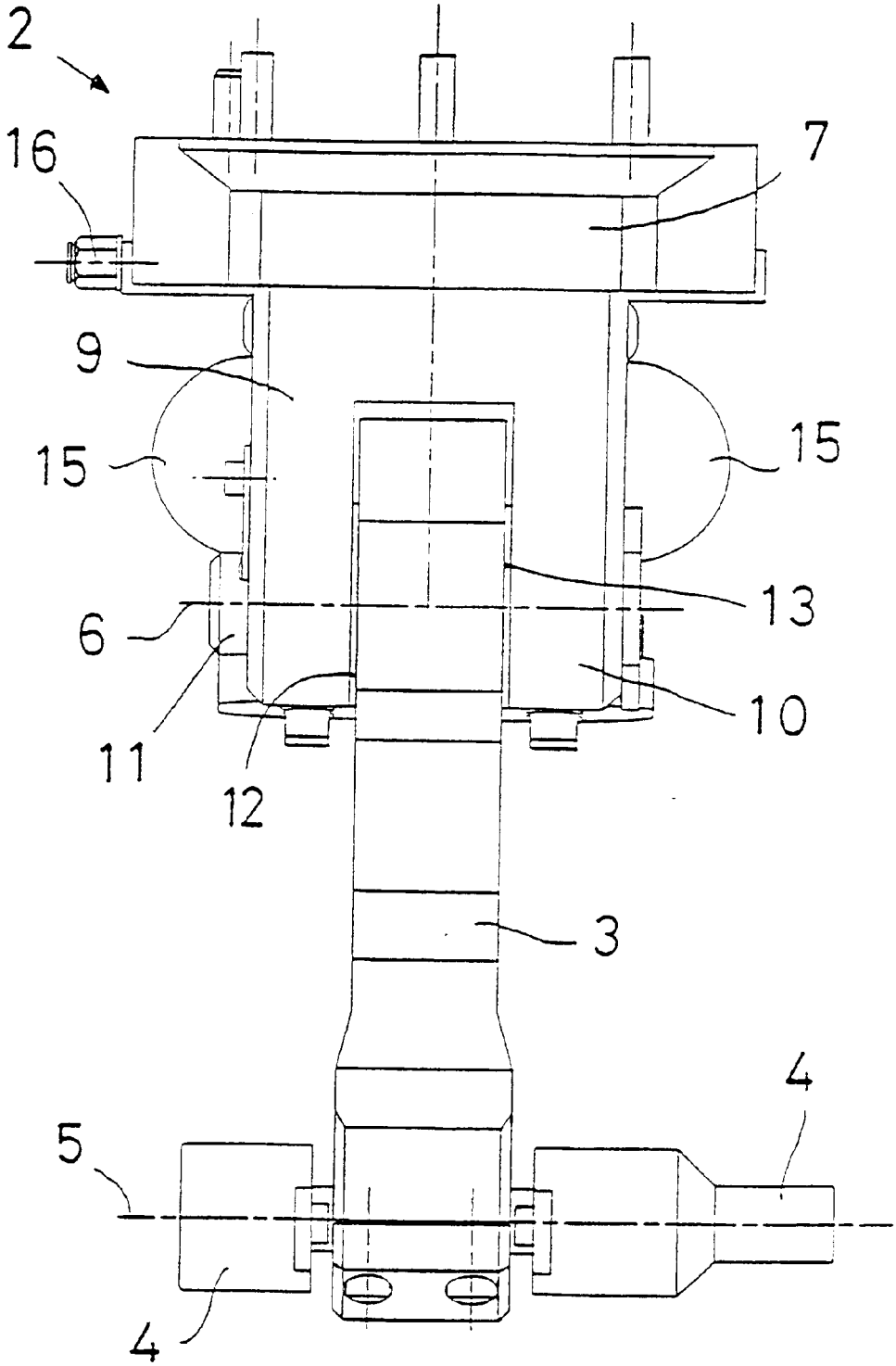
FIG. 2 shows the apparatus according to the present invention seen in the direction of the arrow A in FIG. 1.
Figure 5:
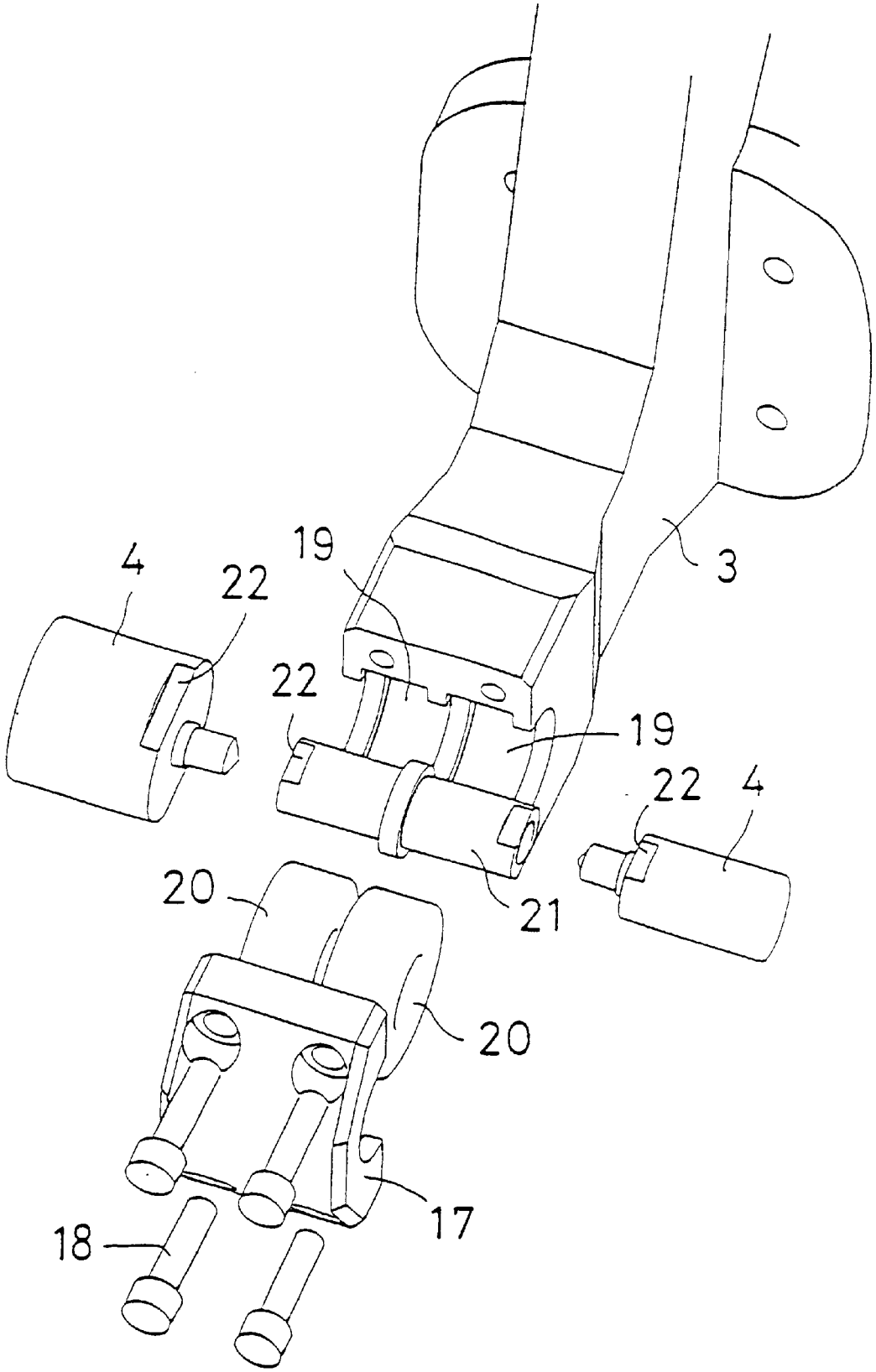
FIG. 5 is an exploded diagram, on a larger scale, of the components of the apparatus carrying the folding roller.

FIG. 5 shows the securement of the folding roller 4 in the lower end of the second or lower support member 3. It will be apparent from the Drawing that the support member has a lower bearing cover 17 which is securable in the support member by means of screws 18. Both the bearing cover and the lower end of the lower support member 3 have seats 19 for accommodating and fixedly locking rolling bearings 20. The rolling bearings 20 accommodate a stub shaft 21 which, at opposite ends, has threaded bores in which the folding rollers 4 may be screwed in place. (The folding rollers illustrated in FIG. 5 differ from those illustrated in FIGS. 1–3 and thereby demonstrate how the folding rollers are readily interchangeable). In order to facilitate screwing in place of the folding rollers, these—and also the stub shaft 21—have keyways 22.

Figure 6:
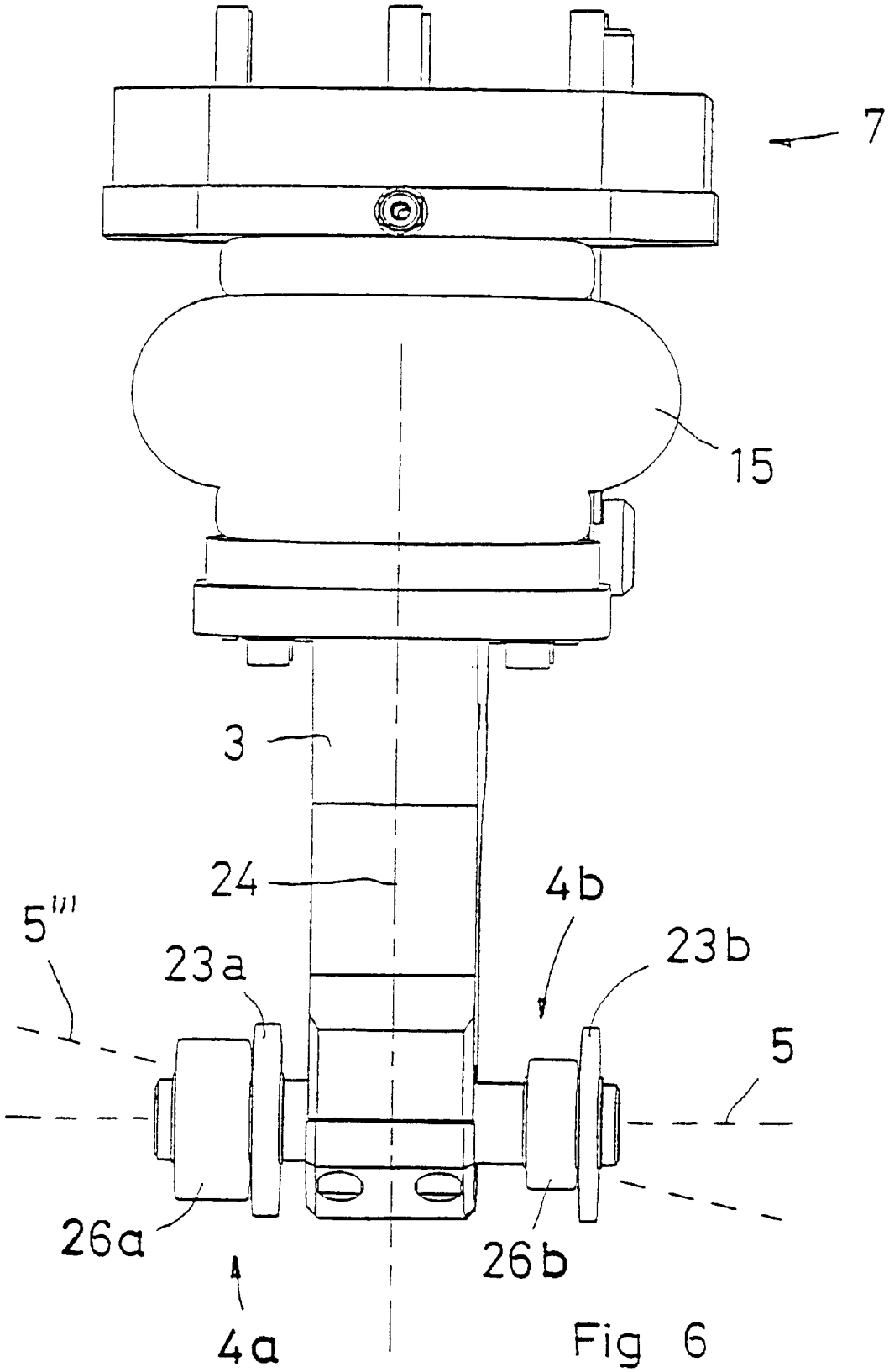
FIG. 6 shows a first modified embodiment of the apparatus according to the invention, seen in the direction of the arrow A in FIG. 1.

FIG. 6 shows a modified embodiment of the apparatus according to the present invention. In this embodiment, the axis 5 (or a counterpart thereto) carries a folding roller 4 which includes a support roller 23*a* and a plane roller 26*a*. Suitably however, it may have two plane rollers 26*a* and 26*b* and two support rollers 23*a* and 23*b*, one support roller and one plane roller being disposed at each one of the opposite end portions of the axis or shaft 5. As is apparent from the Drawing, the support rollers are of greater diameter than their respective plane rollers and are intended to roll and support against the workpiece or the support bed 28 on which is rests. Further, all rollers are individually rotary about their axis.

A variation of this embodiment is intimated in FIG. 6 by the broken line 5''', which implies that the axis of rotation 5''' of the rollers 4*a*, 4*b*, 23*a* and 23*b* still lies in the same plane as the original axis 5 but at an angle with it.

Figure 3:
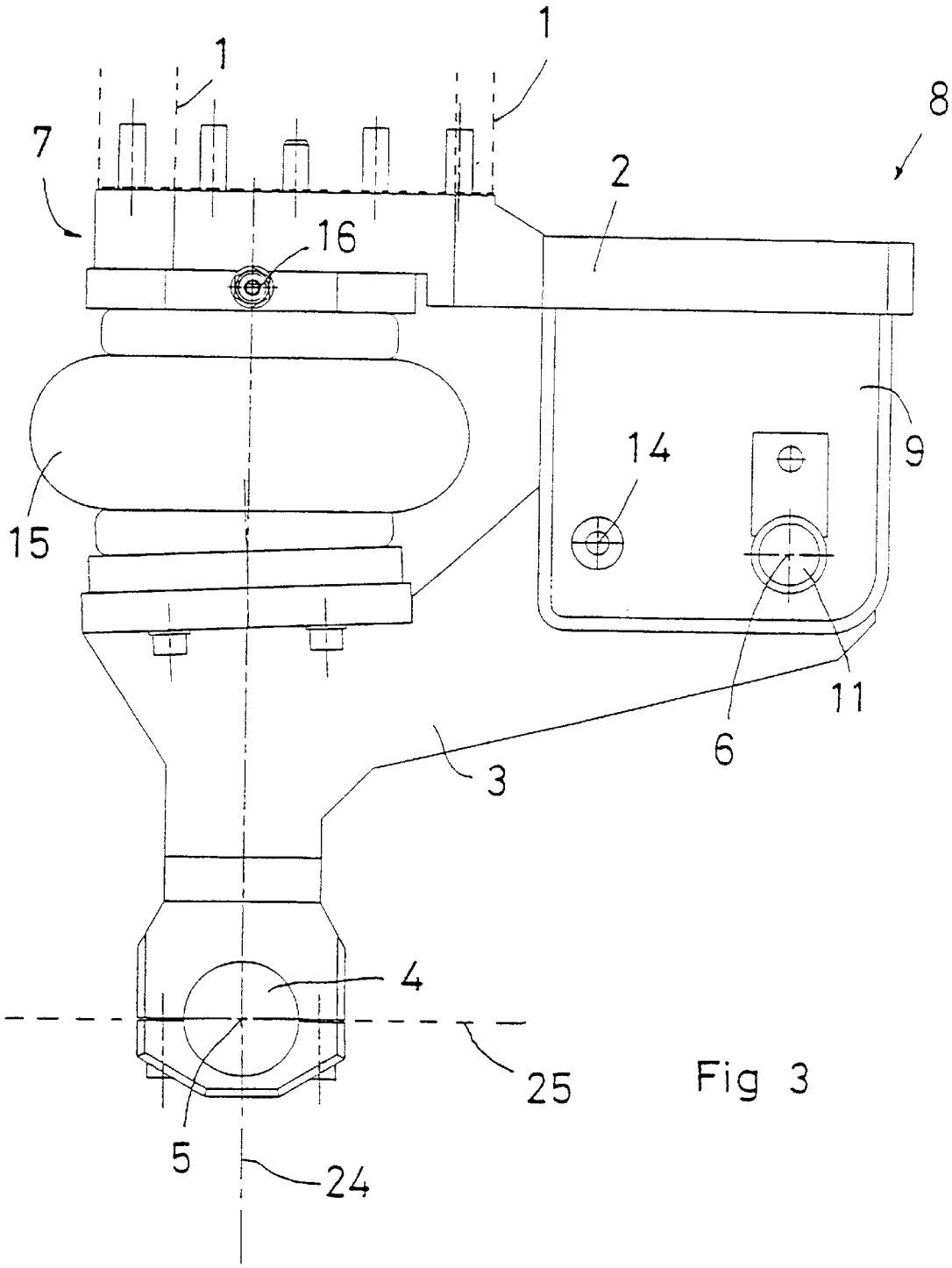
FIG. 3 is a side elevation in the direction of the arrow B in FIG. 1.
Figure 4:
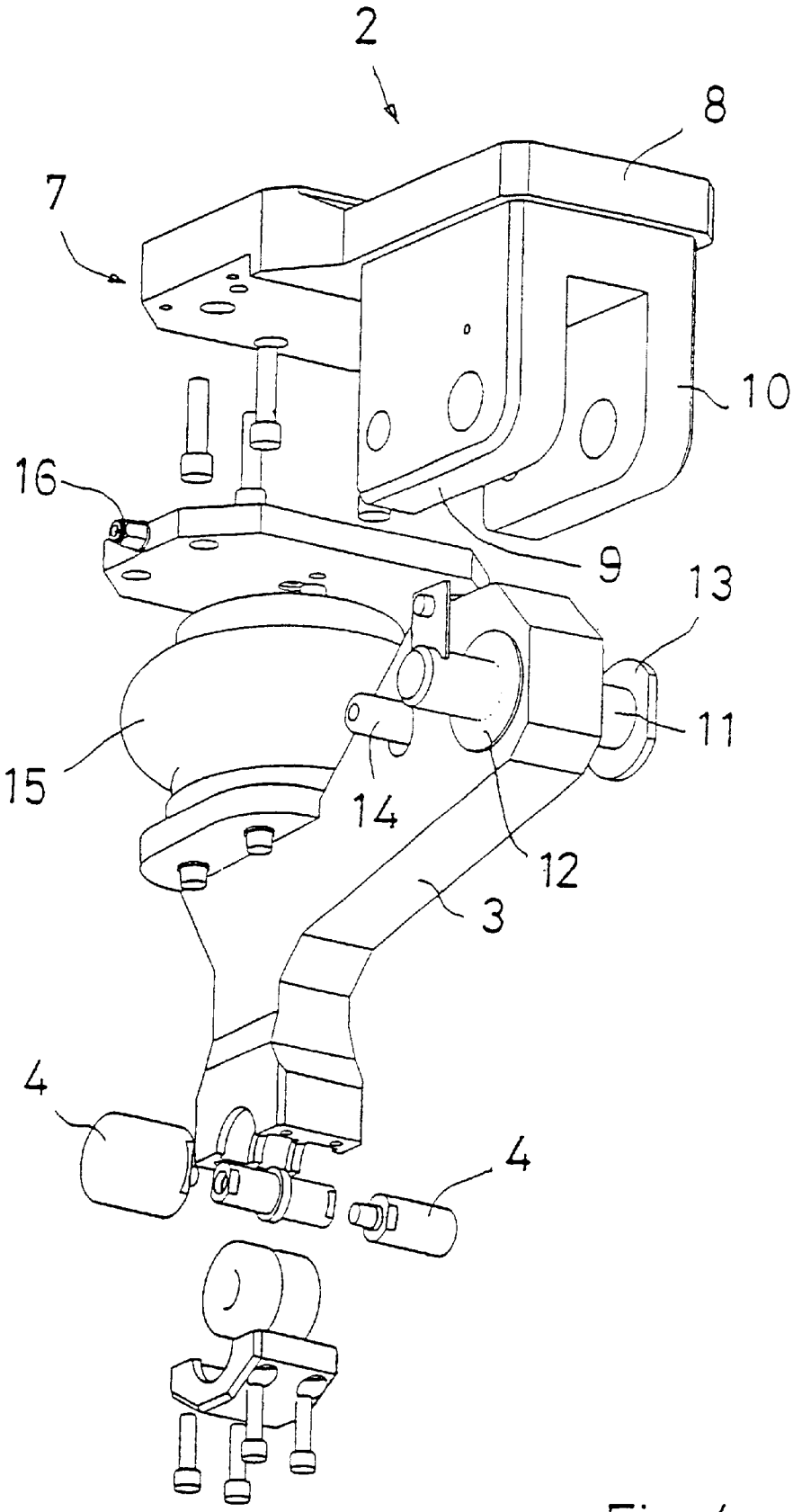
FIG. 4 is an exploded diagram of the apparatus according to the present invention.
Figure 7:
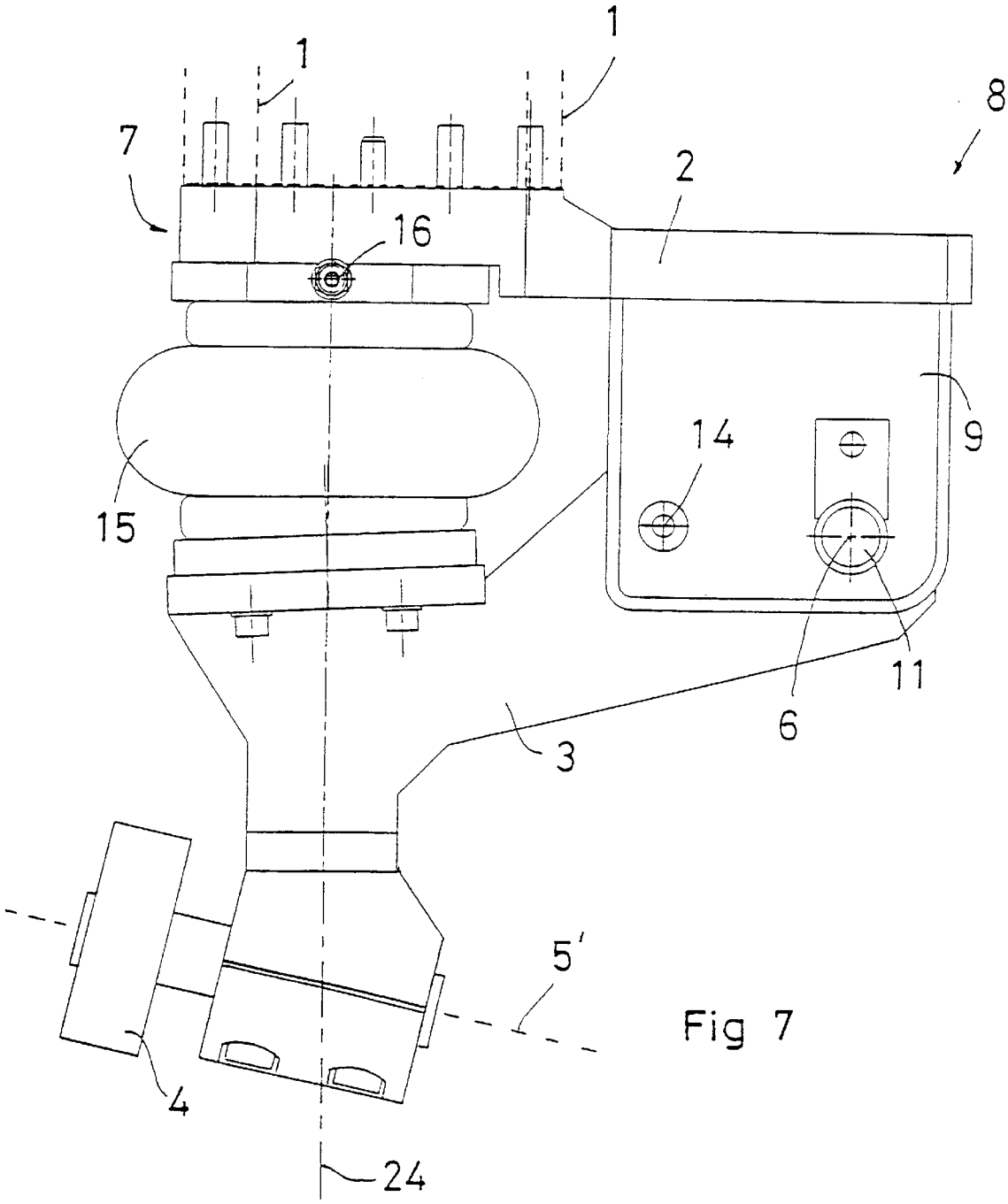
FIG. 7 is a view corresponding to that of FIG. 3 of a second modified embodiment of the apparatus according to the present invention.
Figure 8:
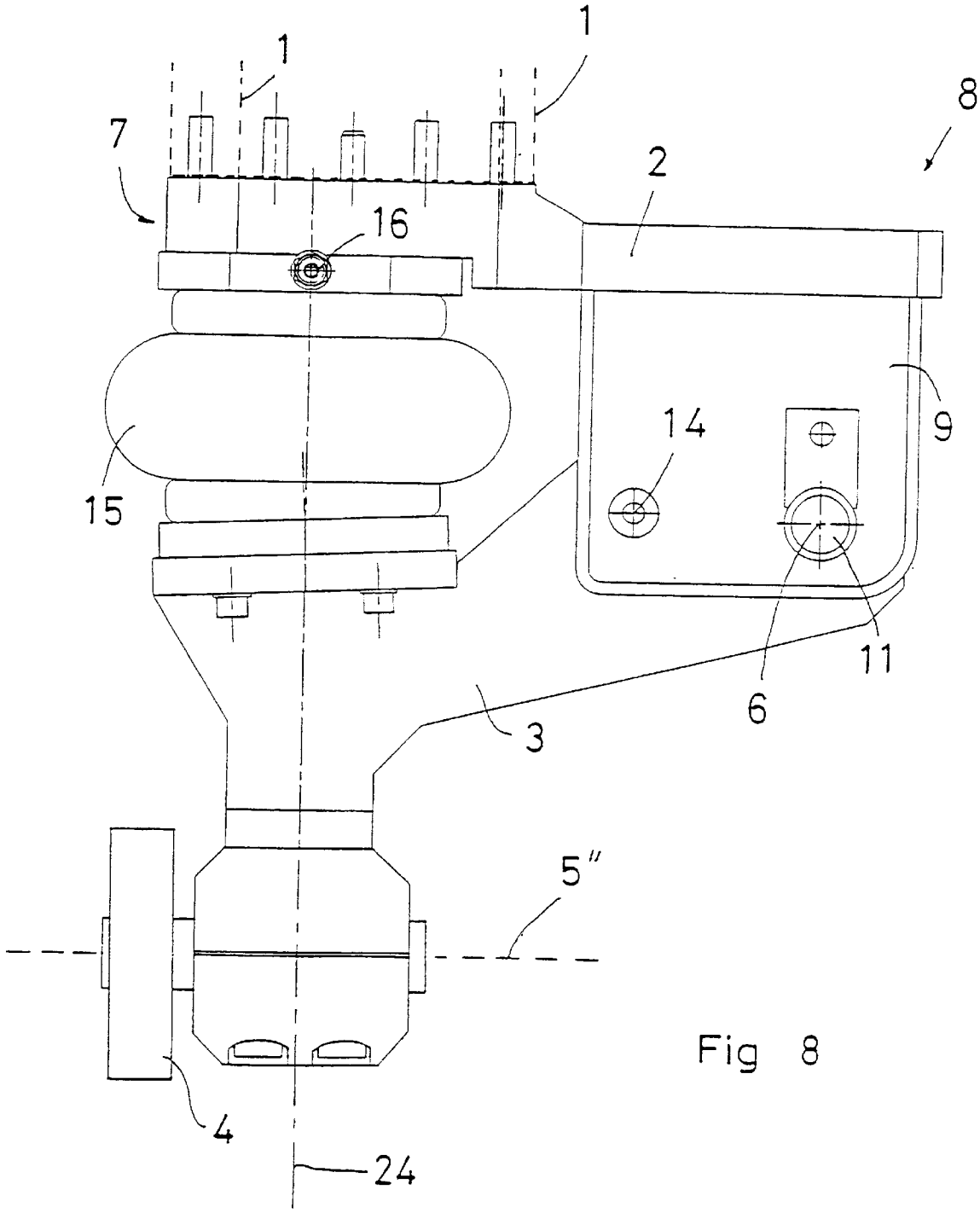
FIG. 8 is a view corresponding to that of FIG. 3 of a third modified embodiment of the apparatus according to the present invention.

In the foregoing, the shaft 5 supporting the roller or rollers (both the guide and folding rollers) has been described as parallel with the pivot axis 6 of the second support member 3. In alternative embodiments, this is not necessary or desirable. Hence, the shaft 5, or more correctly its counterpart as intimated above, may have optional orientation about a vertical axis 24 which is shown in FIGS. 3 and 6 and which may be a normal to the upper surface 27 of the first support member 2 which abuts against the manipulator 1 of the robot. Further, it is possible to give a counterpart 5', 5'' and 5''' to the shaft or axis 5 optional orientation about a recumbent axis 25 which is shown in FIG. 3 and which is at right angles to the vertical axis 24. Examples of such various alignments of the shaft or axis carrying the roller or rollers are shown in FIGS. 6, 7 and 8 at 5', 5'' and 5'''.

The present invention also includes the embodiment in which the part of the lower support member 3 carrying the roller or rollers (both guide rollers and folding rollers) has more than one shaft for supporting one or more rollers each. These shafts may have all of the above-indicated orientations and may be parallel with one another or make an angle with one another.

Figure 9:
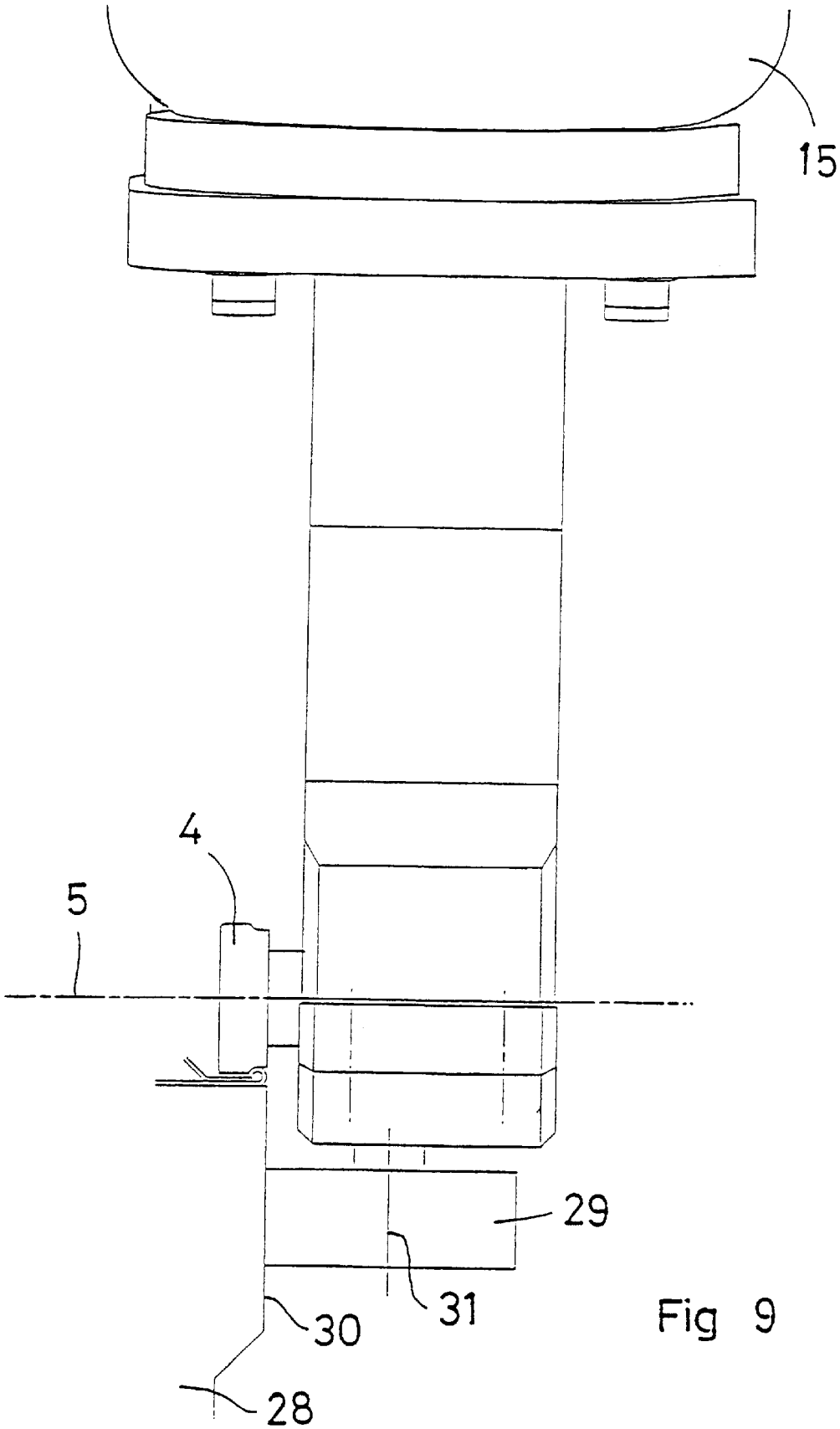
FIG. 9 is a view corresponding to that of FIG. 6 of a fourth modified embodiment of the apparatus according to the present invention.

FIG. 9 shows yet a further embodiment of the present invention. In this embodiment, a guide roller 29 is included which is intended, at least during the final phase of a folding operation, to guide and improve the precision in the path of movement of the folding roller 4 by running along a guide path 30 provided for this purpose on the support bed 28.

In the embodiment illustrated in FIG. 9, the guide roller 29 has an axis of rotation 31 which is substantially at right angles to the axis of rotation 5 of the folding roller 4 and approximately parallel with the vertical axis 25 illustrated in FIG. 6. However, the orientation of the axis 31 of the guide roller 29 need not necessarily be as that described above, but must be adapted to the orientation of the guide path 30 of the support bed 28.

In the embodiment according to FIG. 9, the guide roller 29 may have a running path with a coating of a resiliently yieldable or elastic material such as a plastic or rubber material. Alternatively, such material may be disposed on the guide path 30.

Finally, the present invention also includes embodiments where the bellows 15 is replaced or supplemented by other springs, such as saucer springs, helical springs, spiral springs, torsion springs, leaf springs, etc.

What is claimed is:

1. A folding tool for automatic roll folding, and comprising a first member (2) fixed to a manipulator, a second member (3) movably connected to the first member (2) and including a first folding roller (4), and a spring disposed to permit a relative movement between the first member and the second member, under the action of a force increased by the movement, characterized in that the second member is rotatably connected to the first member (2) with the force of the spring directed radially with respect to the folding roller.

2. The folding tool as claimed in claim 1, characterized in that the first member (2) includes two lugs (9, 10) which surround the second member (3); and that a shaft (6) runs through the lugs and the second member and permits rotation of the second member (3) in a normal plane to the shaft and which prevents movement in other directions.

3. The folding tool as claimed in claim 1, characterized in that the spring comprises a gas spring which has an expandable bellows (15) containing a gas.

4. The folding tool as claimed in claim 3, characterized in that the pressure in the gas spring is variable by the external supply or evacuation of gas.

5. The folding tool as claimed in claim 1, characterized by a guide roller (29) which is disposed, at least during a final phase of a folding operation, to abut against and follow a guide path (30) on a support bed (28) on which the workpiece rests during the folding operation.

6. The folding tool as claimed in claim 1, characterized in that the first folding roller (4) includes a support roller (23)

and a plane roller (26), the support roller being of a diameter which is greater than that of the plane roller and the rollers being disposed to freely rotate about the same axis (5, 5', 5", 5'").

7. The folding tool as claimed in claim 1, characterized in that the second member (3) includes a second folding roller (4) which is rotary about an axis which is separate from the axis of the first roller.

8. A method of roller folding by means of a folding tool comprising the steps of affixing a first member to a manipulator; movably connecting a second member to the first member said second member provided with a folding roller; and actuating said second member by a spring force directed away from the first member, whereby the second member is pivotal relative to the first member with the force of the spring directed radially with respect to the folding roller.

9. The method as claimed in claim 8, wherein said actuating step comprises utilizing the spring force realized by means of a gas spring comprising a gas filled, expandable bellows.

10. The method as claimed in claim 9, wherein said actuating step comprises varying the spring force by the supply and evacuation of gas to and from the bellows, respectively.

11. The method as claimed in claim 8, comprising the additional step of guiding the folding roller in a lateral direction of a fold which is produced such that a guide roller is caused to follow a guide path on a support bed on which a workpiece rests.

12. The method of claim 8 comprising the step of using said folding tool in an industrial robot for folding automotive parts.

13. A folding tool for automatic roll folding, comprising:

a first member having a fixed means for fixing it to a section of an industrial robot that is movable along a movement pattern, a second member having a first folding roller rotatably fastened thereto, connecting means pivotably connecting the first and second members thereby allowing relative movements of the first folding roller towards and away from the first member, and spring means disposed between the first and second members and effective to urge the second member and the first folding roller provided thereon, away from the first member.

14. A roll folding apparatus, comprising:

a support bed for supporting a work piece, an industrial robot having a manipulator effective for moving a first folding roller along a movement pattern on the work piece, a first member fastened to the manipulator, a second member pivotably connected to the first member and including the first folding roller, and a spring means disposed to permit a relative movement between the first and second members under the action of a force generated by moving the first folding roller along the movement pattern.

* * * * *